United States Patent [19]

Greenwood

[11] Patent Number: 4,921,458

[45] Date of Patent: May 1, 1990

[54] UPRIGHT ROLLING TOY ASSEMBLY

[76] Inventor: Donald L. Greenwood, 3117 Lakeshore Dr., Longmont, Colo. 80501

[21] Appl. No.: 306,707

[22] Filed: Feb. 3, 1989

[51] Int. Cl.[5] ..... A63H 3/16; A63H 7/00; A63H 11/10; A63H 13/18

[52] U.S. Cl. ..... 446/101; 446/269; 446/273; 446/289; 446/325

[58] Field of Search ..... 446/101, 97, 268, 269, 446/273, 274, 279, 280, 281–285, 286, 289, 290, 291, 292, 293, 294, 322, 324, 325, 326, 396, 431, 437, 433

[56] References Cited

U.S. PATENT DOCUMENTS

| | | | |
|---|---|---|---|
| 383,442 | 5/1888 | Crandall | 446/101 |
| 2,349,492 | 5/1944 | Eakin | 446/274 |
| 2,365,071 | 12/1944 | Gumb | 446/294 |
| 2,501,632 | 3/1950 | Peden | 446/274 |
| 2,649,805 | 8/1953 | Lohr | 446/286 |
| 3,740,895 | 6/1973 | Nagasaka | 446/101 X |
| 3,807,085 | 4/1974 | Campbell, Jr. | 446/273 |
| 4,107,872 | 8/1978 | Tucker et al. | 446/290 |
| 4,292,759 | 10/1981 | Nagode | 446/289 |
| 4,599,077 | 7/1986 | Vuillard | 446/94 X |

FOREIGN PATENT DOCUMENTS

| | | | |
|---|---|---|---|
| 1210868 | 2/1986 | U.S.S.R. | 446/325 |

*Primary Examiner*—Mickey Yu

*Assistant Examiner*—D. Neal Muir

*Attorney, Agent, or Firm*—James E. Pittenger

[57] ABSTRACT

A self-righting upright rolling toy figure is provided which can be molded in half sections and assembled into a body forming the figure. Weights are mounted in the lowermost portion of the sides of the halves in precise location to form the necessary righting and stabilizing forces. A wheel having a relatively wide rim and hollow interior portion is pivotally mounted within the halves with the lower portion of the wheel exposed below the body surface for rolling contact on a support surface. The mounted counterbalancing weights are positioned within the rim of the wheel in symmetrical configuration and spaced slightly inward from the inner surface of the rim which is in contact with the support surface. A circular cap can be attached to the upper portion of the assembled body halves to seal and secure the halves. Suitable sockets are provided on each side of the figure in a position coaxial with the axle rotatably supporting the internal wheel. Various assemblies can be formed by interconnecting the figures between themselves by the use of elongated pins inserted in the provided sockets as well as inserting shafts or pins into the figure sockets for supporting carts, wagons, wheelbarrows or other objects. The figures can have any body design desired whether it be a human figure, animal or inanimate object configurations. The shapes, color and design can be any arrangement desired.

19 Claims, 3 Drawing Sheets

UPRIGHT ROLLING TOY ASSEMBLY

FIELD OF THE INVENTION

This invention is directed to a toy which rolls on a wheel and remains upright at all times. It is more specifically directed to a self-righting, upright rolling toy which can be interconnected with other like toys to form assemblies encompassing various objects such as wagons, carts and handles.

BACKGROUND OF THE INVENTION

It has been well known in the past to provide various types of rolling toys with some form of push or pull propulsion. In most of these toys, two or more wheels are usually provided for allowing the toy to move freely over a supporting surface. The major drawback of this type of toy is the lack of any provision to allow this toy to be self-righting so that it always remains on its wheels. Thus, the common pull or push toy will merely fall over, if it is upset. If the toy, on the other hand, can be self-righting it will always return to a vertical upright position and be ready to be pulled or pushed no matter how violently it is moved.

In prior art toys, the self-righting characteristic is well known in stationary toys. These are the type of toys that have a rounded weighted base or bottom and have sufficient weight to allow it to return to an upright position when hit or upset in any direction. In years past, no toys combined the rolling and the self-righting feature which, in turn, would make a very desirable toy if it would function properly.

Although attempts have been tried in recent years to make a self-righting upright toy, none of these toys have been quite satisfactory and have proven to be unreliable. In some instances, the counterbalancing weights have not been positioned properly and consequently, the toy will right itself in some situations, but not all. This is especially true if flat surfaces are present on any of the surfaces of the toy which requires additional counterbalancing forces to obtain the upright condition. In addition, without the counterbalancing weights being positioned properly, the toy will not always remain in an upright position when it is being used especially if it is being subjected to violent and sudden push or pull movements.

In addition to the lack of a self-righting feature in most prior art rolling toys, none of these types of toys have been intentionally put together in an assembled condition to allow a number of rolling toys to be used together. In addition; there has been no provision to allow an upright self-righting rolling toy to be used in an assembled condition to provide the wheels or rolling elements for various combinations including wagons, wheelbarrows, and circular rotating assemblies.

The present invention overcomes this drawback by providing a self-righting rolling toy and arrangements for connecting the toys together by interconnecting links or rods which can be used to join two or more of the toys together with a T-shaped handle or to position the toys on either side of various objects to be supported. In this use, the upright rolling toys provide the means for propelling a central object.

INFORMATION DISCLOSURE STATEMENT

The following section is provided in order to comply with the applicant's acknowledged duty to inform the Patent office of any pertinent information of which he is aware.

The applicant is unaware of any patented devices or prior art references which in any way disclose the novel features which are provided in the present invention. This is not to imply that a patentability search has or has not been performed prior to the filing of this application.

SUMMARY OF THE INVENTION

This invention is directed to a novel rolling toy structure wherein the toys are shaped as a replica of a human figure, animal or inanimate object. The shape for the animal can be such as a chicken, horse, dog, elephant, etc. The inanimate object can take the form of a locomotive, airplane, car, or the like. Of course, it is to be understood that the toy can be made into any shape required which has a desired pleasing effect. One of the important considerations is that connecting sockets can be provided on either side, front or back of the toy for the purpose of linking the toys together into assemblies.

The individual rolling toy object or figure takes the shape of a round elongated body which houses a relatively wide substantially open or hollow wheel. The housing for the toy figure is primarily formed in two symmetrical halves with the halves extending along and completely covering the sides of the wheel to protect the wheel and extend almost to the supporting surface for the toy. A counterbalancing weight of sufficient magnitude is precisely located in the lower portion of each half of the toy at a point within the wheel and slightly spaced from the bottommost area of the revolving wheel. This allows the counterbalance to maintain the toy figure in an upright rolling position as well as self-righting the figure to the upright position whenever it is tipped or displaced.

The center of gravity of the device is extremely low with respect to the overall volume of the toy figure which provides the desired upright positioning moment as well as the self-righting characteristics of the object. The two halves of the body of the figure are held together by an axle which, in turn, provides the support for the rotating wheel. A cap used in the enhancement of the appearance of the toy figure is also used to secure the halves of the figure in their relative position.

The front and back of the body portion of the figure's housing is cut away to permit observing an alternating foot pattern arrangement provided on the outer circumference of the wheel. In this way, it appears that the object is walking as it is rolled forward across a supporting surface. Sockets or connectors are provided on the outer surfaces of the figure to accommodate interconnecting pins or rods to connect the figures together into an assembly. The connector sockets are arranged coaxial with the axle upon which the wheel is mounted. In this way, the position of the center of gravity of the figure even when attached to the other figures will remain unchanged which stabilizes the overall performance. A socket can be provided on both sides of the figure so that the assembly connection can be made side to side or the sockets can be positioned on the front and/or back to allow the figures to be positioned in tandem.

The toy figures with the connecting socket feature can be interconnected with any other similar or dissimilar rolling toy figures to form a number of play assemblies. These assemblies can take on various configurations such as the interconnecting rod can pass through aligned holes in the sides of a wagon body and these ends can be connected to two toy figures. With figures at both the front and back, a rolling wagon assembly can be formed. A small wheelbarrow assembly can be attached to the side sockets provided on a single figure forming a rolling wheelbarrow toy assembly. Any toy figure combination can be provided interconnecting the units as desired and obtaining a desired play assembly. Of course, it is also to be understood that the toy figures can be interchanged with various body configurations and are not limited to just using the human figures with human figures. Any mixed or matched combination of toys can be used to form the various assemblies.

BRIEF DESCRIPTION OF THE DRAWINGS

Other features and advantages of the present invention will become apparent from the following detailed description wherein like reference numbers denote the same elements in the accompanying drawings.

DETAILED DESCRIPTION OF THE DRAWINGS

Figure 1:
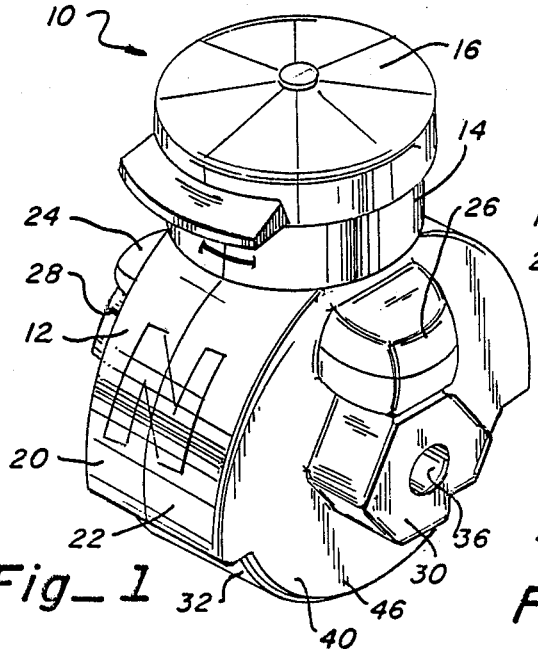
FIG. 1 is a perspective view of the upright rolling toy figure according to the present invention.
Figure 2:
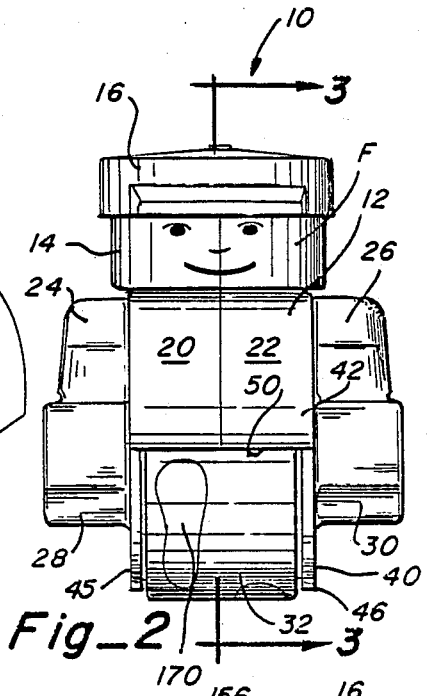
FIG. 2 is a front view of the figure.
Figure 10:
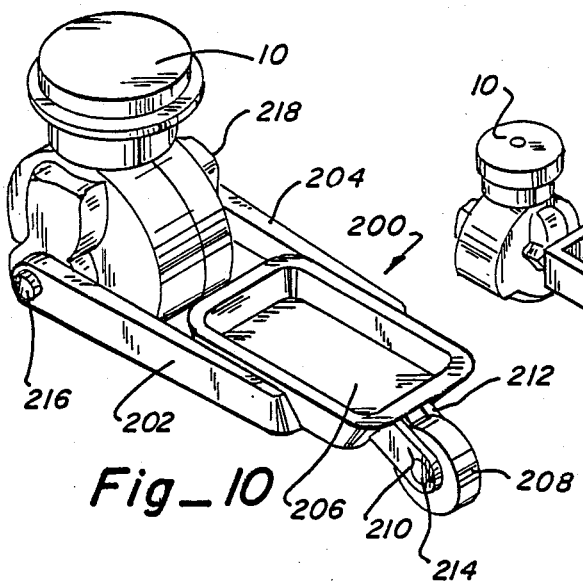
FIG. 10 is a pictorial projected view of the rolling toy figure assembled with a wheelbarrow device.

Turning now more specifically to the drawings, FIGS. 1 and 2 show an upright toy FIG. 10 which forms the base element for this invention. The toy FIG. 10 includes an enlarged body 12, head 14, and cap 16. The body 12 is a generally small hollow housing having side halves 20, 22 and arms 24, 26 having hand areas 28, 30, respectively. A comparatively large wheel 32 pivotally mounted between the two body halves 20, 22 has a substantial diameter and width which generally fills the internal cavity of the body 12. Apertures forming connectors or sockets 34, 36 are provided in the hand areas 28, 30, respectively. The sockets 34, 36 are, as will be explained later, used for joining a number of the upright toy figures together into an assembly for use with other components. The sockets 34, 36 are aligned coaxially with the axle pivotally supporting the wheel 32.

The body 12 of the FIG. 10 can have a generally round configuration when viewed from the side and a generally rectangular configuration when viewed from the top which substantially corresponds with the size of the internal revolving wheel 32. It is to be understood throughout this application that the body configuration can take on the shape or replicate human figures as well as animals or other objects such as birds, cats, alligators, trains, airplanes, boats or any other figure which is desired to provide a pleasing appearance for a pull or push toy. The body can be painted or molded to provide various forms of dress or outer appearance as desired. In addition, the head 14 can have a face F painted thereon or the image can be provided by decals. The cap 16 is a functional item which is used to assemble and retain the halves 22 of the body 12 together in a secured structure forming the FIG. 10. By the same token, the outline of alternating footprints can be positioned on the outer perimeter of the wheel 32 so as to give the appearance that feet are moving as the wheel 32 rotates while the figure is rolling forward.

To better understand the novel structure of this invention, it is necessary to take a look at the internal components which make this combination a self-righting, free-wheeling, upright toy figure.

Figure 3:
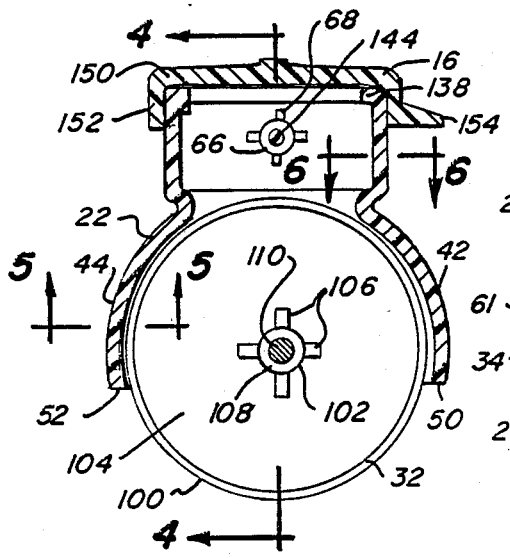
FIG. 3 is a cross sectional view taking along the lines 3—3 of FIG. 2.
Figure 4:
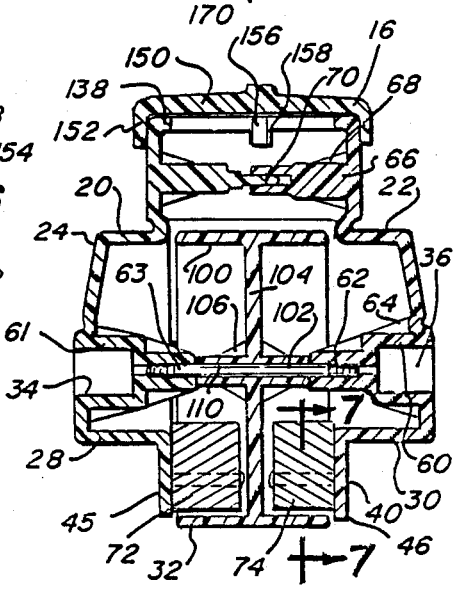
FIG. 4 is a cross-sectional view taken along lines 4—4 of FIG. 3.

FIGS. 3 and 4 show the internal structure of the FIG. 10. The two halves 20, 22 of the body 12 are made usually by injection molding or any other suitable process to form hollow individual symmetrical components. For illustration purposes, only the right half 22 will be discussed in detail. The left half 20 is essentially a mirror image except for some minor differences which will be discussed later. The reference to the left and right halves of the body 12 is made with respect to the observer viewing the toy figure from the front.

The body 12 is essentially a hollow housing or shell which is made up of the halves 20, 22. The right half 22 includes essentially flat side 40, curved front section 42 and rear section 44. The thickness of the walls making up the shell or half 22 will usually fall within the range of 1/32nd to ⅛th inch depending upon the material being used and the strength desired. In addition, the cost or expense in molding the individual components is also a consideration.

As illustrated in FIG. 1 the side 40 has an outer cavity forming the arm 26 and the hand 30. The side 40 also extends downward below the hand 30 essentially forming a skirt 46 which completely encloses the side of the wheel 32. The skirt 46 essentially follows the same radius as the wheel, except it is slightly shorter so as to not contact the supporting surface on which the wheel 32 rolls. In this way, the body 12 is essentially an enclosed figure with the wheel only being exposed in the front and rear of the figure below the edges 50, 52 of the front and rear section 42, 44 respectively. In this way, the assembled FIG. 10 looks like an inanimate object when viewed from the sides and top with only the wheel seen from the front or rear.

As described above, the arm portion 26 and the hand portion 30 are protuberances extending outwardly from the side 40 of the half 22. Although the outward extension of the arm 26 is unnecessary, the portion represented by the hand 30 is desirable. On the inside surface of the half 22 corresponding to the hand 30 is an inwardly extending support stanchion 60. The support stanchion 60 has a double stacked cylindrical configuration with the socket 36 extending inwardly from the outer edge of the hand area 30 and a central bore 62 formed in the innermost portion of the stanchion 60. A plurality of reinforcing gussets 64 can be positioned around the outer surface of the stanchion 60 to provide additional support and rigidity. The innermost surface of the stanchion 60 which corresponds to the outer edge of the bore 62 is precisely positioned as well as the total depth of the bore itself is predetermined. This arrangement which will be explained later allows the wheel 32 to freely rotate within the body 12 without excessive side play.

A second support stanchion 66 is provided in the head portion 14 of the body 10. The second stanchion 66 is essentially a solid cylinder extending inwardly perpendicular from the inside surface of the head portion. This stanchion includes a central bore 70 and is arranged generally parallel to the first support stanchion 60 and in the same plane. The central bore 70 issued in conjunction with a diametrically opposite stanchion to join the two body halves 20, 22 together. If desired, the second stanchion 66 can have a plurality of reinforcing gussets 68 formed around the base to add additional strength and rigidity.

Figures 5, 6, 7, 8, 9:
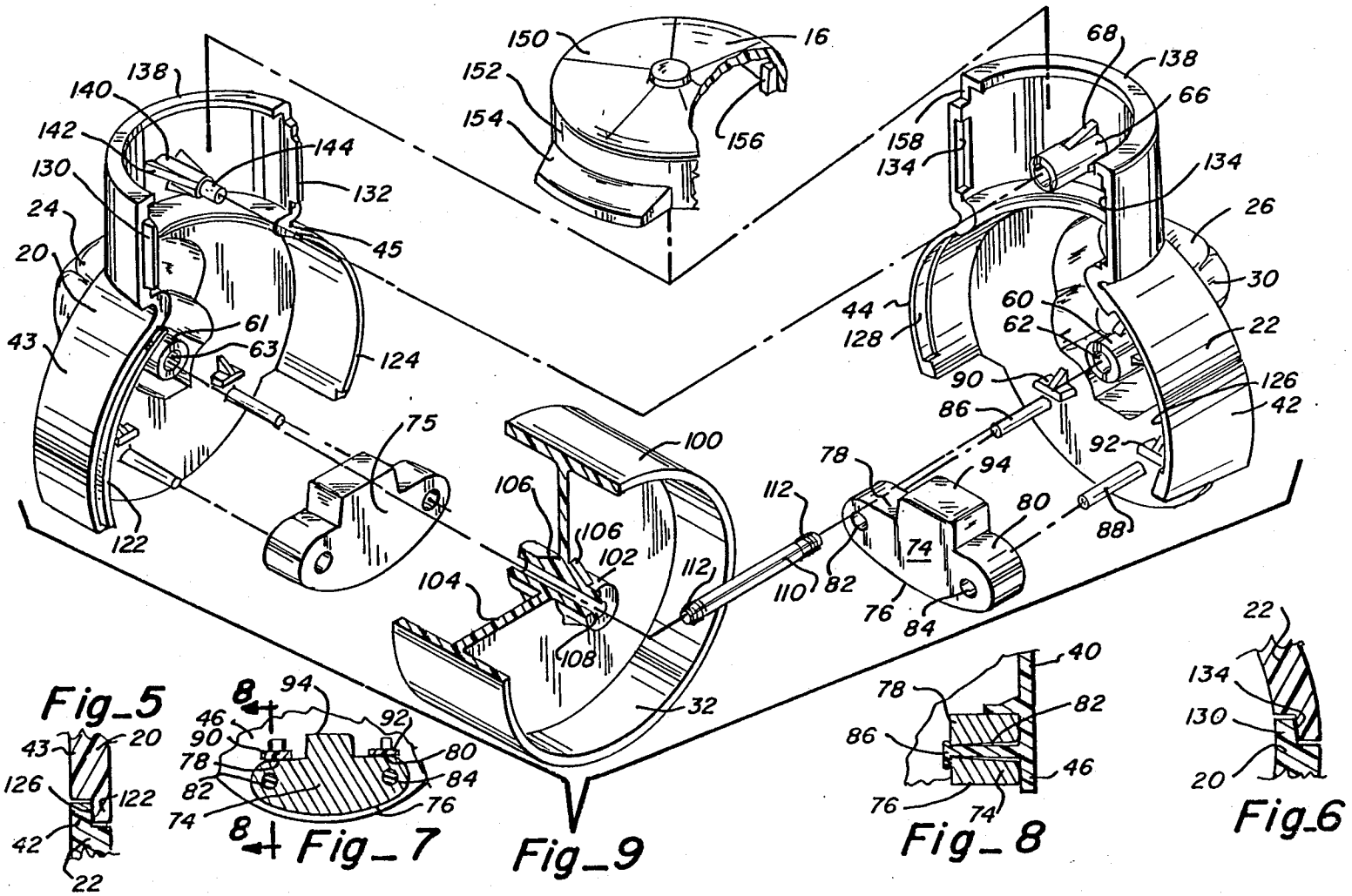
FIG. 5 is a partial cross-sectional view showing the edges between the figure halves taken along lines 5—5 of FIG. 3.
FIG. 6 is a partial cross-sectional view taken along lines 6—6 of FIG. 3.
FIG. 7 is a partial side cross-sectional view taken along lines 7—7 of FIG. 4.
FIG. 8 is a partial cross-sectional view taken along lines 8—8 of FIG. 7.
FIG. 9 is an exploded view showing the assembly of the components making up the figure according to the present invention.

A critical area of the present invention is incorporated into the weight structure which is provided for the upright FIG. 10. Two counterbalancing weights 72, 74 are each mounted respectively within the body halves 20, 22. The weight 74 for the right body half 22 has a generally curved bottom surface 76 and two substantially flat upper surfaces 78, 80. A pair of holes 82, 84 are provided through the outer ends of the weight 74 and positioned a precise distance from the flat surfaces 78, 80, respectively. The generally curved surface 76 is arranged to have the same diameter or less than the bottom edge of the skirt 40. In this way, the bottom surface of the weight can be positioned slightly spaced inwardly from the bottom edge of the skirt 46 so that it will not be visible from the outside. The apertures 82, 84 as can be visualized in FIG. 8 can have a rounded edge on one side with the aperture 82 tapered slightly from the rounded edge to the opposite side. This configuration aids in the assembly of the weights to the halves of the body. Mounting pins 86, 88 which have a length slightly greater than the thickness of the weight 74 is molded or affixed to the inside surface of the skirt 46 of the side 40. The distance between the pins is the same as the distance between the apertures 82, 84 formed in the weight 74 with the positioning of the pins precisely predetermined to mount the weights in the required location. This location is quite important to the functioning and operation of the toy figure according to the present invention.

Reinforced weight securing stands 92, 90 are precisely positioned and spaced from pins 86, 88 respectively. A flat surface is provided on each of the stands 90, 92 and extends perpendicular from the inside surface of the skirt 46. This surface is provided to correspond and contact the flat surfaces, 78, 80 which are provided on the weight 74.

The weight 74 is mounted to the inside surface of the skirt 46 by sliding the weights 74 over the mounting pins 86, 88. With the surfaces 78, 80 of the weight 74 firmly positioned against the flat surfaces of the stands 90, 92 and the weight firmly held against the inside surface of the skirt 46, a soldering iron or a similar hot object is momentarily touched against the outer ends of the pins 86, 88 so as to melt and deform the excess material of the pins against the outer surface of the weight 74 to form a head or shoulder to firmly hold the weight 74 against the inside surface of the body half 22. This prevents any movement or repositioning of the weight during use.

The pins 86, 88 and the reinforcing support stands 90, 92 serve the purpose of properly locating the weight 74 and permanently mounting it in the body. Outside of the bottom curved surface and the flat surfaces provided on the weight 74, the outer surface of the weight can have any configuration desired and can include an enlarged section 94 if additional material is required to achieve the desired weight requirements for the particular toy figure.

As stated previously, the other half 20 of the body 12 is essentially a mirror image and the weight 75 mounted in this half is essentially identical to the weight 74 to provide symmetrical balance and stability in the FIG. 32.

The wheel 10 has a relatively wide rim 100 which is formed from thin material. The rim 100 is connected to the centrally positioned hub 102 by solid or perforated disk 104. The disk 104 is formed from generally thin material and is centrally positioned within the rim 100. The hub 102 is formed as a sleeve or cylinder having a predetermined length and is symmetrically positioned with respect to the disk 104 and rim 100. The hub 102 also can have reinforcing gussets 106 strategically positioned around the perimeter of the hub and on both sides of the disk 104. A central bore extends the length of the hub 102 and is positioned coaxially with the axis of rotation of the rim 100. An axle or shaft 110 having a plurality of barbed or serrated rings 112 formed at each end is provided for rotatably mounting on the wheel 32. The diameter of the axle 110 is slightly less than the inside diameter of the bore 108 provided in the hub 102 and is slightly greater than the bore 62 and 63 formed in the support stanchions 60, 61 respectively. As will be explained later, the axle 110 helps to not only rotatably support the wheel 32, but also helps to position and secure the body halves 20, 22.

Although it is not absolutely necessary, the edges of the front and rear sections 43, 45 of body half 20 can have continuous projections 120 and 122 which are approximately half of the thickness of the body surfaces 43, 45. By the same token, the edges of the front and rear sections 42, 44 of body half 22 can be undercut to form continuous grooves 126, 128, respectively. The grooves 126, 128 are sized to properly receive the projections 120, 122 and produce an overlapping lip configuration which is detailed in FIG. 5. This lip construction allows the edges of the body halves 20, 22 to be properly aligned and to support each other for strength and also to provide a gluing surface for joining the edges together.

By the same token, the edges of the head portion 14 of the body halves 20, 22 can also have edge projections 130, 132 and mating grooves 134, 136. These projections and grooves form the same function as those described for the body portion and are detailed in FIG. 6. In addition, the top edge of the head portion 14 includes an inwardly extending flange 138 which adds rigidity and strength to the upper edge of the body 12.

An inwardly extending stanchion support 140 is provided on the inside surface of the head portion 14 of the body half 20. This support can be reinforced by gussets 142 if desired to provide rigidity. As stated before, the support 140 is positioned diametrically opposite and aligned with the second support stanchion 66 provided in the opposite half 22. A pin 144 is centrally positioned at the top of the support 140 and is sized to frictionally interfit the bore 70 formed in the stanchion 66. The shoulder at the base of the pin 144 is intended to be properly dimensioned from the inside surface of the body half 20 so it properly mates and contacts the outer edge of the stanchion 66 when the body halves are assembled.

The cap 16 has a cover portion 150 and a circumferential lip 152 which extends downwardly from the outer perimeter of the cover 150. An outwardly extending bill 154 can be formed in the hat to provide realism if desired and depending upon the type of figure which is intended. The inside diameter of the lip 152 is sized to be slightly greater than the outside diameter of the head portion 14 of the body 12. A key 156 can be provided on the inside surface of the lip 152 and arranged to match a slot 158 formed in the edge of the flange 138 and joint between the rear portion of the two halves 20, 22 of the body 12.

In order to assemble the FIG. 10, it is merely necessary to properly position and secure the weights 74, 75 within the body halves 22, 20, respectively. The axle 110 is inserted through the bore 108 in the hub 102 of the wheel 32 and one end of the axle 110 is started into either the bore 63 in the support stanchion 61 or the bore 62 in the support stanchion 60. The two body halves 20, 22 are then positioned so that the axle 110 is loosely positioned in the bores provided in the stanchions. At the same time, the edges of the body halves are aligned so that the grooves and projections provided along the edge surfaces will properly interfit and the supports 66 and 140 will mate. The halves are then forced together.

The length of the axle 110 is precisely determined so that once it is seated in the bores 62, 63, the ends of the axle will bottom in the bores in the two stanchions at the same time with the edges between the body halves contacting to provide a flush joint. The serrated ends of the axle 110 provide a gripping action 62, 63 to hold the aligned body halves together in proper position. At the same time, before mating the edges, it is also possible to provide a thin coating of glue on the edges to seal the edges and secure the halves. Also, for extra rigidity, a small amount of glue can be applied to the pin 144 to adhere it to the bore provided in the support 66.

With the two halves 20, 22 properly secured together and the wheel 32 rotatably mounted within the halves, the upper area of the head portion 14 of the body can be covered and secured by the cap 16. A small amount of glue can be applied to the upper surface of the lip 138 and the cap can be aligned and installed with the key 156 fitting the slot 158 and the outer lip 152 of the cap fitting down over the outer perimeter of the head portion 14 of the FIG. 12.

As mentioned previously, alternating footprints 170 can be painted or imprinted on the outer surface of the rim 100 of the wheel 32 so that it appears that feet are actually moving as the upright toy figure is rolled along a supporting surface.

It is quite important to the successful operation of the figure that the weights 74, 75 be properly positioned in the lower portion of the inside surface of the skirt portions 46, 45, of the body halves 22, 20. The lower curved surface of the weights 74, 75 allow the weights to be positioned within inside surface of the rim 100 and closely adjacent to the disk 104 of the wheel 32. In this way, with the body halves assembled, the weights are positioned inside the wheel and are spaced only a slight amount from the inside surface of the rim 100. In this way, the weights are positioned symmetrical with the center portion of the hub 102 and the FIG. 10. The center of gravity of the weights cause the center of gravity of the figure to be fixedly positioned directly below the axle 110. In this way, the maximum self-righting fulcrum is provided with respect to the central rotating hub of the wheel 32.

As can be seen in FIGS. 1 and 2, all of the surfaces on the toy FIG. 10 have some curvature including the upper surface of the cap 16. With the predetermined position of the center of gravity of the figure with respect to the outer surfaces a self-righting characteristic is provided which is automatic and nearly instantaneous. Even though the sides of the hand portions 28, 30 are shown relatively flat, these portions are offset from the center of gravity a sufficient amount which still allows the righting forces to properly position the FIG. 10 in an upright position. In this way, no matter what upsetting force is applied to the toy FIG. 10 it always returns to the upright position and rolling on the wheel 32.

Additional uses and benefits can be obtained with the toy FIG. 10. As previously described, the bores 34, 36 provided in the side portions of the figure provide sockets or connectors for attaching interconnecting rods or pins. The sockets 34, 36 are precisely positioned coaxially with the axle 110 so that any pivoting of a pin or rod will coincide with the pivoting of FIG. 10.

Figure 11:
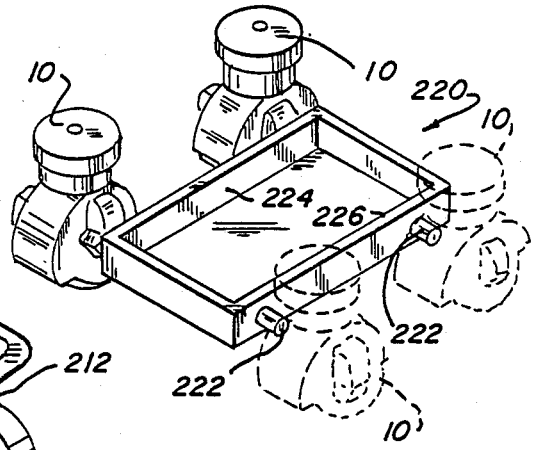
FIG. 11 is a pictorial projected view showing the rolling toy figures used as the wheels for a wagon assembly.
Figure 12:
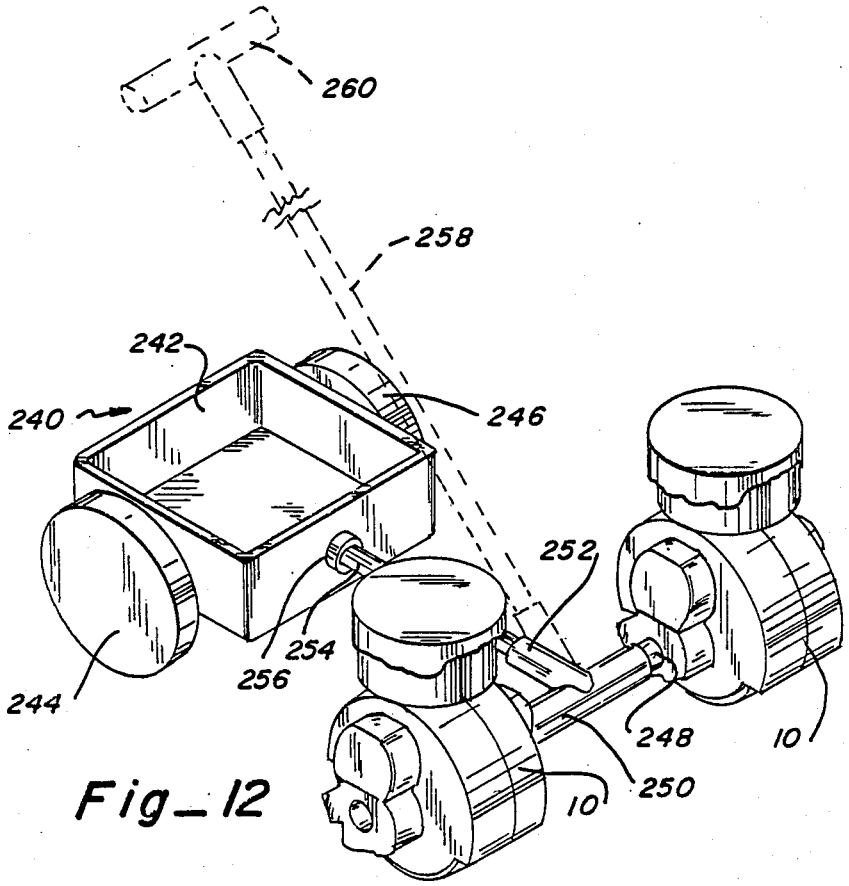
FIG. 12 is a pictorial projected view showing two figures and a wagon assembly along with an alternative push handle shown in phantom.

FIGS. 10, 11 and 12 show several basic play assemblies for the upright toy FIG. 10 according to the present invention. In FIG. 10 is seen a wheelbarrow attachment device 200. The wheelbarrow device 200 includes elongated side arms 202, 204 which are attached to the sides of a box-like body 206 which is supported by a wheel 208 which is mounted on a pair of forwardly extending legs 210, 212. An axle or shaft 214 extending between the legs 210, 212 rotatably mounts the wheel 208. Pins 216 and 218 are inwardly positioned in the outer ends of the arms 202, 204 and are sized to easily fit within the sockets provided on each side of the figure 10. By springing the arms outwardly the pins 216, 218 can be attached to or removed from the toy FIG. 10 as desired. Because of the low center of gravity of the FIG. 10 and the width of the wheel 32 mounted within the body of the figure, lateral stability of the assembly is quite adequate. In fact, without additional weight in the box 206, the assembly formed by the FIG. 10 and wheelbarrow 200 still can retain some of its uprighting characteristics.

FIG. 11 shows another assembly utilizing a wagon 220 having a plurality of pins 222 properly aligned and projecting from the sides 224, 226 of the wagon 220. The pins 222 are sized to frictionally fit the side sockets or connectors of a plurality of FIGS. 10. In this illustration, two of the figures are shown in phantom so that the positioning of the pins 222 in the wagon side 226 can be seen. It is to be understood that the same pin arrangement is provided on the outer surface of the side 224 of the wagon. In this way, a plurality of the figures can form the rolling elements for supporting and moving the wagon 220 as an assembly. It is also understood that any other vehicle body can be substituted for the wagon body 220 shown in this illustration.

FIG. 12 also shows another use for the figures in providing rolling support for a cart assembly 240. The bed of the cart 242 is supported by separate wheels 244, 246 which are rotatably mounted on pins mounted on the sides of the cart 242 or on a shaft which is suitably mounted under the cart 242. An elongated pin 248 is passed through a loose fitting sleeve 250 with the ends of the pin 248 inserted into the proper sockets provided on the sides of a pair of FIGS. 10. In this way, the FIGS. 10 are assembled in side by side arrangement. The sleeve 250 has a T-connector 252 into which a connecting rod 254 can be slidably inserted. The end of the connecting rod 254 can be inserted into a connector 256 attached to the cart 242. With the cart 242 supported on the rotating wheels 244, 246, the entire assembly can easily roll across or along a supporting surface.

It is also possible that instead of attaching the connecting rod 254 to the cart 242, an elongated rod or shaft 258 can be substituted in the T-connector 252. A T-handle 260 can be attached to the other end of the rod 258 and the handle 260 can be pivotally positioned to provide a push or pull force for the assembled toy figures.

While a number of assemblies have been shown and described in this application, it is to be understood that any number of assemblies can be formed with the upright figures and components which are shown and described herein. These assemblies can be made from any number of toy figures and which form a part of this invention.

Another assembly which can be provided for the figures is a tiltable rolling surface which can be a flat surface having a lip at each end and is supported by a double-tapered surface which has an apex under the center portion of the flat surface. By tilting the flat surface back and forth on the apex, the figures can be caused to roll back and forth on the upper surface. This additional assembly allows the figures to be moved and played with in a very small area.

Most all of the components which are used in making the figures and assemblies which are shown and disclosed in this application can be formed form easily molded plastic materials such as polyvinylchloride, polyurethane, polypropylene, etc. By the same token, it is also possible that any number of other materials can be used to form some or all of the components such as synthetic resins, metals or any other materials which can be easily formed, shaped or cast.

It goes without saying that the weights used in the described figures must have sufficient specific density for the space available to provide the desired righting and stabilizing characteristics. Naturally, lead can be used for this purpose as well as other heavy metals. For a small rolling toy, it is anticipated that these weights will be approximately one to two ounces each. This provides a combined total counterbalancing weight for each figure of two to four ounces. It has been found that this total weight provides the desired characteristics when the total height of the figure is approximately three and one-half to four inches with a wheel diameter of approximately two and one-half inches. With these dimensions, the distance of the center of gravity of the weights below the axle for the wheel shall be approximately one inch which provides the required righting force. The total width of the figure using these proportions is approximately two and one-half inches. It is necessary to keep these proportions in the same approximate ratio so that the lever arm will remain essentially the same to provide the desired characteristics for the figures.

Although an upright rolling figure and assembly has been shown and described in this application, it should be understood that this invention is not to be limited to the exact form or forms disclosed, and changes in detail and construction of the invention may be made without departing from the spirit thereof.

What is claimed is:

1. An upright, rolling toy figure which can be pushed or pulled across a supporting surface and which is self-righting, said toy figure having an outside configuration resembling a common object, the figure comprising:

(a) a hollow body means, having an inside surface and an outside surface, said body means being formed in two separate halves and said body means has front, back and bottom portions;

(b) at least two weight means for counterbalancing said figure, at least one weight means being mounted inside a bottom portion of each half of said body means;

(c) a wheel having a relatively wide, flat rim and hollow on each side, said wheel being rotatable mounted on an axle within said body means when said halves are assembled, said wheel rim having an inside and outside surface, said body means being arranged to enclose the sides of the wheel while leaving the bottom portion and the front and back portions contiguous to said bottom portion open so that the wheel will contact and roll on a support surface without the body means contacting said support surface;

(d) said weights being mounted on said body means halves so that they will extend within the hollow sides of said wheel and are positioned slightly spaced from the inside surface of said rim and adjacent to the portion of the outside surface of the rim in contact with a support surface whereby the body means will produce a self-righting force to maintain the figure in an upright position.

2. A rolling toy figure as defined in claim 1 which further includes a cap means, said cap means being arranged to be mounted on a portion of both body halves to secure the assembled halves and produce a rigid structure.

3. A rolling toy figure as defined in claim 1 wherein said wheel is a single wheel having a rim and hub and a thin disk member centrally positioned to interconnect said hub and rim.

4. A rolling toy figure as defined in claim 3 wherein each of said weight means extends inwardly within said wheel to a point spaced slightly from said thin disk.

5. A rolling toy figure as defined in claim 1 wherein a stanchion support is provided in each half of said body means, said stanchion supports are arranged diametrically opposite within said figure and are arranged to receive and retain the axle upon which the wheel is rotatably mounted.

6. A rolling toy figure as defined in claim 5 wherein said axle includes serrations on each end and each of the stanchions includes a central bore having a diameter which is slightly less than said axle whereby when the axle is inserted within said bores and the body halves are assembled the ends of said axle will grip the respective stanchions to cause the halves to be held together to form said toy figure.

7. A rolling toy figure as defined in claim 6 wherein each of said body halves include an additional stanchion forming a second pair which is arranged diametrically opposite each other whereby when the body halves are assembled, the second pair of stanchions will be coupled to hold the body halves in a rigid toy figure.

8. A rolling toy figure as defined in claim 1 wherein the outside surfaces of said figure is substantially curved.

to assist the weight means to maintain the figure in an upright position.

9. A rolling toy figure as defined in claim 1 wherein the halves of said body means are symmetrical and said wheel is symmetrically and centrally positioned within said halves.

10. A rolling toy figure as defined in claim 1 wherein the outside surface configuration of said figure represents a human form.

11. A rolling toy figure as defined in claim 1 wherein the outer surface of the rim of said wheel includes alternating footprint designs which give the appearance that the figure has moving feet when the figure is rolled forward on the supporting surface.

12. A rolling toy figure as defined in claim 1 wherein the outside surface of said body halves include a connecting socket on each half, said connecting socket being arranged coaxial with the axle rotatably supporting said wheel whereby the individual figures can be joined to form play assemblies by slidably inserting interconnecting rods in the sockets of two or more figures.

13. A rolling toy figure as defined in claim 12 wherein the connecting sockets are centrally positioned in protuberances formed on the outside surface of said body halves.

14. An upright, rolling toy figure which can be pushed or pulled across a supporting surface and which has self-righting attributes, said figure comprising:

(a) a hollow body means having an inside surface and outside surface, said outside surface having a configuration resembling a common form, said body means being formed in two separate symmetrical halves;

(b) a pair of weight means for counterbalancing said figure, one of said weight means being mounted on the inside surface of a lower portion of each of said body halves;

(c) a wide, flat-rimmed wheel having a relatively large hollow portion on each side, said wheel having a rim and hub and a centrally positioned disk interconnecting said rim and hub, said wheel being rotatable mounted on an axle within the body means when said halves are assembled, said body means being sized to enclose the sides of the wheel and leave an open bottom portion whereby the wheel will contact and roll on a supporting surface without interference from the body means;

(d) said weight means being mounted on the inside surface of said body halves so that they are positioned within the sides of the wheel so that they are slightly spaced from the disk and from the rim of said wheel and adjacent to the portion of the rim in contact with a support surface whereby the body means will produce a self-righting force to maintain the figure in an upright position.

15. A toy assembly of upright rolling toy figures which can be pushed or pulled across a supporting surface, said assembly being formed by interconnecting a number of said rolling toy figures, said figures each comprising:

(a) a body means having an outer configuration representing an object;

(b) said body means including a single centrally mounted, wide, flat rimmed, hollow wheel which is rotatable mounted on an axle within said body means, said wheel rim having an inside surface and an outside surface, (c) a pair of weights, each of said weights being mounted within said body means on each side of said wheel so that the weights are positioned within the sides of said wheel and adjacent to the inside surface of the rim which is opposite to the outside surface of the rim in contact with a supporting surface so that the figures can be pushed or pulled whereby the figures can freely roll along the supporting surface and remain in an upright position regardless of externally applied forces; and (d) said figures further include a connecting socket means on each side of said figure coaxial with the axle which supports said wheel and said figures are connected together by connecting rod means which are inserted in said connecting sockets.

16. A toy assembly as defined in claim 15 wherein a toy figure is connected at the connecting socket means to a wheelbarrow means whereby the toy figure provides an upright stabilizing effect to the assembly.

17. A toy assembly as defined in claim 15 wherein a pair of rolling toy figures are connected in side by side position by slidably inserting a connecting rod into the appropriate connecting socket means on each of said figures, said connecting rod means being inserted through a loose-fitting sleeve having a T-connector thereon, an elongated connecting rod having a handle at one end being connected to said T-connector whereby the handle can be used to apply a propulsion force for rolling the figures along a support surface.

18. A toy assembly as defined in claim 15 further including load-carrying means having connecting means whereby said load-carrying means can be connected to said connecting socket means on said figures so that the rolling toy figures can provide rolling elements for said load-carrying means.

19. A rolling toy assembly as defined in claim 15 wherein the figures have an outer configuration of a human form and the connecting socket means are positioned in protuberances formed on each side of the toy figure.

* * * * *